US005873619A

United States Patent [19]

Lewkoski et al.

[11] Patent Number: 5,873,619

[45] Date of Patent: Feb. 23, 1999

[54] ADJUSTABLE DECK LID HINGE ASSEMBLY

[76] Inventors: Randolph D. Lewkoski, 556 Wayne Cressent, Midland, Ontario, Canada, L4R 5E1; Ronald D. McLeod, 55 Burke Dr., Barrie, Ontario, Canada, L4N 7H8

[21] Appl. No.: 690,204

[22] Filed: Jul. 25, 1996

[51] Int. Cl.[6] ..... E05D 7/06

[52] U.S. Cl. ..... 296/76; 396/146.12; 16/241; 16/245

[58] Field of Search ..... 296/76, 146; 16/235, 16/239, 240, 241, 242, 245, 246, 249; 49/380, 399

[56] References Cited

U.S. PATENT DOCUMENTS

| | | | |
|---|---|---|---|
| 3,643,755 | 2/1972 | Gionet et al. | 180/69.21 |
| 4,658,470 | 4/1987 | Oen | 16/241 |
| 4,712,825 | 12/1987 | Braga et al. | 296/76 |
| 4,776,626 | 10/1988 | Seyler | 296/76 |
| 4,825,507 | 5/1989 | Killingstad | 16/241 |
| 4,837,893 | 6/1989 | Wilson | 16/240 |
| 4,893,863 | 1/1990 | Skonieczny et al. | 296/76 |
| 5,029,930 | 7/1991 | Ihrke et al. | 296/76 |
| 5,074,609 | 12/1991 | Dear | 296/76 |
| 5,158,333 | 10/1992 | Saville | 296/76 |
| 5,584,099 | 12/1996 | Westerdale | 16/245 |

FOREIGN PATENT DOCUMENTS

| | | |
|---|---|---|
| 1467178 | 3/1977 | Germany . |
| 696416 | 9/1953 | United Kingdom . |
| 911559 | 11/1962 | United Kingdom . |
| 921567 | 3/1963 | United Kingdom . |
| 2038927 | 8/1982 | United Kingdom . |

*Primary Examiner*—D. Glenn Dayoan
*Assistant Examiner*—Jason Morrow
*Attorney, Agent, or Firm*—Brooks & Kushman, P.C.

[57] ABSTRACT

An adjustable hinge assembly and method for using the same to adjust a cover relative to vehicle opening is disclosed. The adjustable hinge assembly includes a hinge box and an adjustable link pivotally connected to the hinge box about a first pivot axis. The adjustable link includes a mount defining a second pivot axis. The adjustable link may be pivoted relative to the hinge box to adjust the position of the second pivot axis relative to the hinge box. The hinge assembly may be used to mount a hinge strap and deck lid to a backshelf of a vehicle. Pivotally moving the adjustment link relative to the hinge box allows the deck lid to adjust relative to a deck lid opening in the vehicle.

8 Claims, 4 Drawing Sheets

ADJUSTABLE DECK LID HINGE ASSEMBLY

TECHNICAL FIELD

This invention relates to deck lid hinge assemblies which mount deck lids to vehicles and which provide vertical adjustment to the deck lids.

BACKGROUND OF THE INVENTION

Adjustable deck lid hinge assemblies for raising and lowering a deck lid relative to a deck lid opening in a vehicle are known. A first example is described in Saville, U.S. Pat. No. 5,158,333. A hinge strap, affixed to a deck lid, is pivotally attached to a pivot plate. The pivot plate, in turn, is threadedly engaged with a threaded nut mounted relative to a backshelf of a vehicle. By rotating the threaded nut, the pivot plate and hinge strap are axially or vertically linearly translated relative to the backshelf. Accordingly, the forward portion of a deck lid mounted by a pair of such hinge straps and hinge assemblies can be vertically adjusted to flushly mate with the surrounding surface of the vehicle body.

Another example of an adjustable deck lid hinge assembly which provides for linear translation of a hinge strap relative to a backshelf is found in Skonieczny et al., U.S. Pat. No. 4,893,863. An eye bolt is mounted relative to a hinge box affixed to the backshelf of a vehicle. By rotating a nut on the eye bolt, the eye of the eye bolt is linearly translated along the longitudinal axis of the bolt. A pivot pin mounting a hinge strap to the eye bolt passes through the eye of the eye bolt perpendicular to the eye bolt's longitudinal axis. The hinge strap and attached deck lid are raised and lowered as the nut on the eye bolt is rotated providing for the adjustment of the deck lid relative to the deck lid opening in the vehicle.

Moving the pivot axis defined by a pair of hinge assemblies only in a vertical plane has undesirable consequences. The hinge straps and deck lid act as a link extending between the pivot axis and a latch located in the rear of the vehicle. The latch is usually disposed substantially below the height of the pivot axis. The distance is fixed between mounting apertures on the hinge straps which are coaxial with the pivot axis and a latch mechanism on the deck lid. Consequently, when the hinge assemblies' pivot axis and the hinge straps are adjusted in a vertical plane, the latch mechanism at the rear of the deck lid moves fore and aft. This fore and aft movement of the rear of deck lid makes alignment of the deck lid relative to the deck lid opening and vehicle body difficult.

SUMMARY OF THE INVENTION

It is an object of the present invention to provide an adjustable hinge assembly which moves a pivot axis of a hinge strap both vertically and horizontally to reduce fore and aft movement of a vehicle deck lid during adjustment relative to a deck lid opening in the vehicle.

It is another object to provide an adjustable deck lid hinge assembly for a vehicle which allows the pivot axis of a hinge strap to be moved arcuately relative to a hinge box.

It is yet another object to provide a deck lid hinge assembly including a hinge box and an adjustment link pivotally affixed thereto which pivots about a first pivot axis, the adjustment link having a mount which pivotally mounts a hinge strap about a second pivot axis spaced from the first pivot axis, and an adjustor which arcuately positions the adjustment link relative to the hinge box to adjust the hinge strap and attached deck lid relative to a deck lid opening in the vehicle.

It is a further object to provide a method for adjusting a hinge strap and deck lid relative to a hinge box attached to a vehicle by interconnecting the hinge box and hinge strap using an intermediate adjustment link which pivots relative to the hinge box thereby providing curvilinear translational adjustment of the hinge strap and deck lid relative to the hinge box and vehicle deck lid opening.

An adjustable hinge assembly for mounting a cover to a vehicle over a vehicle opening is disclosed. Preferably, the cover is a decklid. The hinge assembly comprises a hinge box and an adjustment link. The adjustment link is pivotally mounted to the hinge box about a first pivot axis and has a mount defining a second pivot axis spaced from the first pivot axis. When the hinge box is affixed to the vehicle and the cover is affixed relative to the adjustment link, the adjustment link can be pivoted relative to the hinge box to move the second pivot axis relative to the hinge box thereby adjusting the position of the cover relative to the vehicle opening. Ideally, the hinge assembly also includes an adjustor, such as a threaded fastener or screw, which adjusts the position of the adjustment link and second pivot axis relative to the hinge box. In turn, the position of the cover relative to the vehicle opening is adjusted. Further, a lock mechanism for locking the adjustment link in a fixed position relative to the hinge box, after adjustments have been made, may be provided.

The method includes pivotally moving the adjustment link relative to the hinge box to adjust the position of the cover or deck lid relative to the vehicle opening.

BRIEF DESCRIPTION OF THE DRAWINGS

These and other features, objects and advantages of the present invention will become readily apparent from the following description, pending claims, and accompanying sheets of drawings where:

BEST MODE FOR CARRYING OUT THE INVENTION

Figure 1:
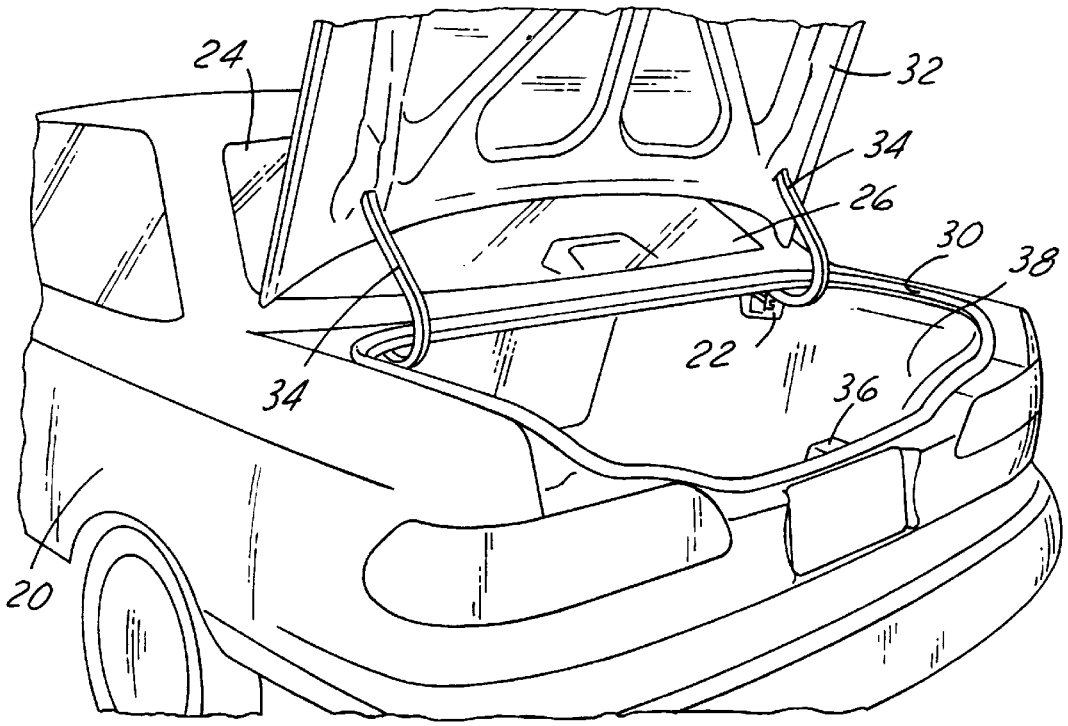
FIG. 1 is a fragmentary perspective view of a vehicle which uses a pair of adjustable deck lid hinge assemblies, made in accordance with the present invention, to adjustably mount a deck lid to the vehicle.

FIG. 1 shows a vehicle 20 employing a pair of hinge assemblies 22 made in accordance with the present invention. Vehicle 20 has a rear window 24 disposed above a generally horizontally extending backshelf 26. A deck lid opening 30 is defined in the rear of vehicle 20. A deck lid 32 is supported by a pair of laterally spaced apart hinge straps 34 which are pivotally mounted by hinge assemblies 22 to back shelf 26. Deck lid 32 moves between an open position, as shown, and a closed position wherein deck lid 32 closes over deck lid opening 30. Deck lid 32 releasably attaches to a latch 36 in trunk compartment 38 located adjacent the rear of deck lid opening 30.

Figure 2:
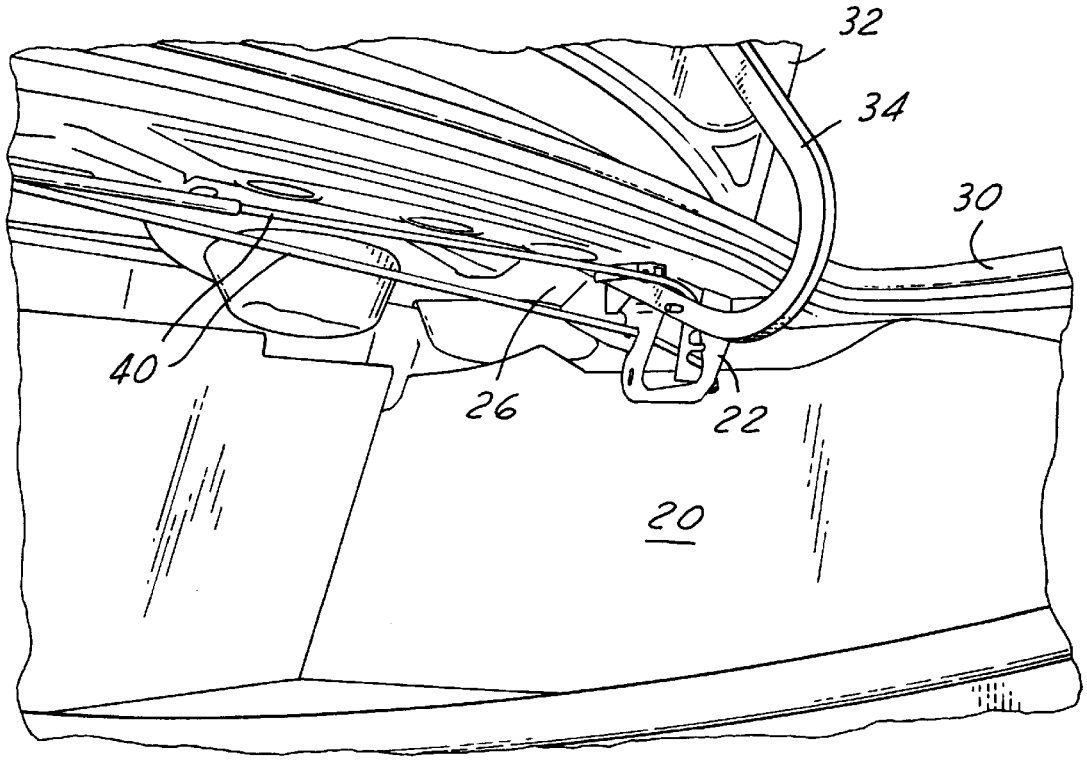
FIG. 2 is a fragmentary perspective view from within the vehicle trunk compartment of one of the hinge assemblies mounting a hinge strap and the deck lid to the vehicle.

FIG. 2 shows one of the hinge assemblies 22 securing beneath backshelf 26 in trunk compartment 38. Again, deck lid 32 is shown in the open position being supported by hinge straps 34. A pair of criss-crossing torque rods 40 extend between hinge assemblies 22 and are used to bias deck lid 32 to its open position. Consequently, little effort is required to lift deck lid 32 to its fully open position. Likewise, due to the weight of deck lid 32, only a small downward force is required to close deck lid 32 relative to deck lid opening 30.

Figure 3:
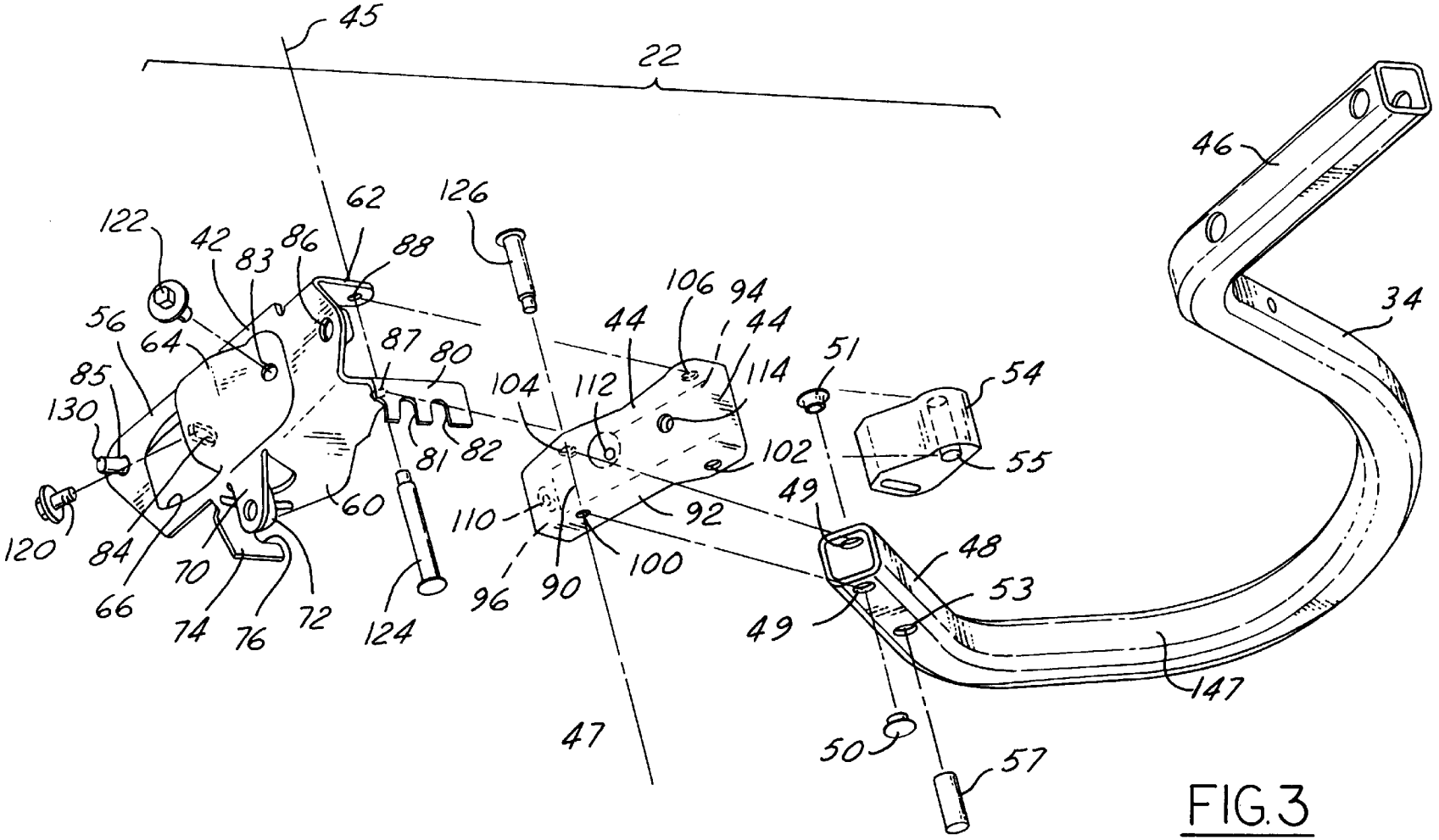
FIG. 3 is an exploded perspective view of one of the adjustable hinge assemblies and a hinge strap.
Figure 4:
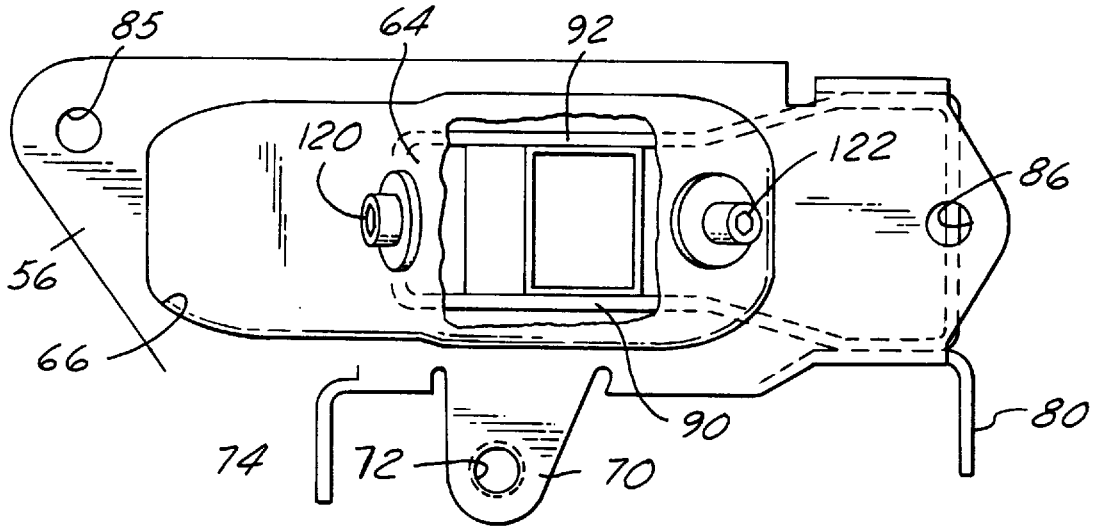
FIG. 4 is a fragmentary top view of one of the adjustable hinge assemblies mounting to a backshelf of the vehicle.
Figure 5:
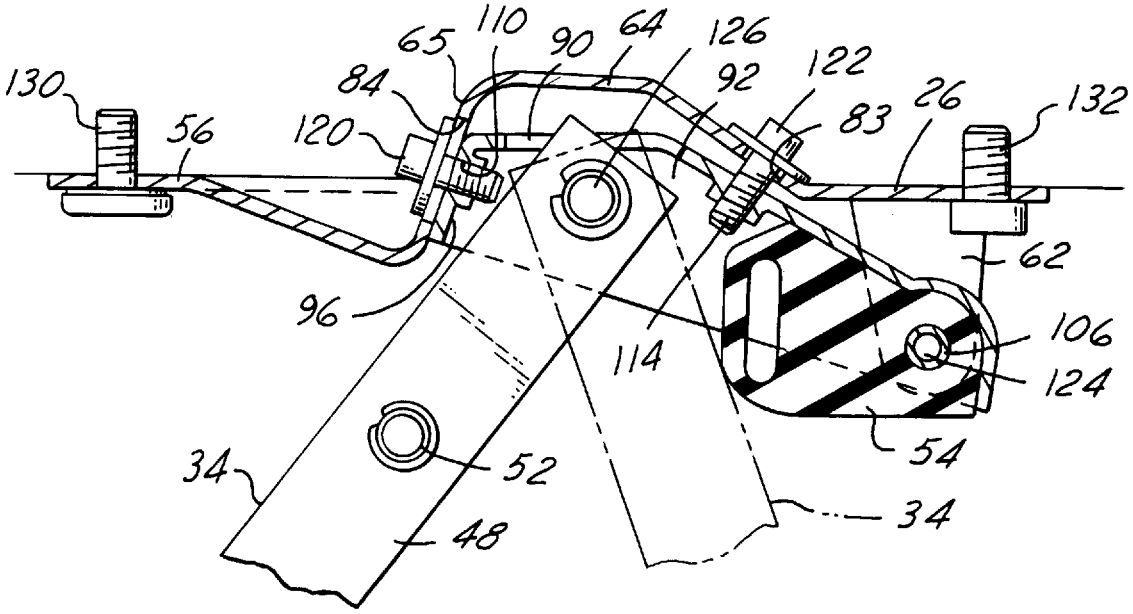
FIG. 5 is a fragmentary side view, partially cutaway, showing a hinge strap pivotally mounting to a hinge assembly.

One of hinge assemblies 22 and one of hinge straps 34 are shown in FIGS. 3–5. Each of the hinge assemblies 22 and hinges straps 34 are generally similar to the other. Therefore, only one of the hinge assemblies 22 and one of the hinge straps 34 will be described in greater detail.

Hinge assembly 22 comprises a hinge box 42 to which an adjustment link 44 is pivotally connected about a first pivot axis 45. Adjustment link 44, in turn, pivotally supports a hinges strap 34 about a second pivot axis 47. Consequently, by pivoting adjustment link 44 relative to hinge box 42, second pivot axis 47 may be pivotally and arcuately adjusted to provide both vertical and horizontal components of movement to hinge strap 34.

Hinge strap 34 includes an elongate distal portion 46, an intermediate goose neck portion 147 and an elongate proximate portion 48. Distal portion 46 attaches beneath the forward portion of deck lid 32. Proximate portion 48 has a pair of laterally spaced holes 49 therein which receive a pair of respective pivot bushings 50 and 51. A torque rod bushing 52 is disposed in another pair of holes 53 in proximate portion 48 and slidably receives an end of one of the torque rods 40.

An elastomeric bumper 54 is provided to cushion the impact of hinge strap 34 thereon when deck lid 32 is opened. Bumper 54 includes a laterally extending through hole 55.

Hinge box 42 has a top wall 56, inboard and outboard flanges 60 and 62 which depend downwardly from top wall 56 and a domed wall 64 extending over top wall 56. Domed wall 64 includes a vertically extending forward wall portion 65. An access opening 66 is formed in top wall 56 to accommodate proximate portion 52 of hinge strap 34. A mounting lug 70 with a threaded nut 72 affixed thereto projects laterally inboard from top wall 56. A forward torque retaining wall 74 having a single notch 76 and a rear torque retaining wall 80 having notches 81 and 82 extend inboard from inboard flange 60. Notches 76, 81 and 82 serve to anchor torque rods 40 as shown in FIG. 2.

An access hole 83 is provided in the top of domed wall 64 and an elongate slot 84 extends vertically in forward wall portion 65 of domed wall 64. Top wall 56 includes forward and rear mounting holes 85 and 86. Pivot holes 87 and 88 are coaxially aligned in the rear portions of respective inboard and outboard flanges 60 and 62 and serve to define first pivot axis 45 about which adjustment link 44 pivots.

Adjustment link 44 is generally cup-shaped and has a top wall 90, inboard and outboard flanges 92 and 94 and a forward flange 96, all of which depend downward from top wall 90. Inboard and outboard flanges 92 and 94 have respective coaxially aligned apertures 100, 102, 104 and 106. Apertures 100 and 104 serve as a mount for attaching adjustment link 44. Forward flange 96 has a threaded aperture 110 and top wall 90 has apertures 112 and 114. Aperture 112 is threaded to receive a threaded fastener.

Fasteners are used to assemble hinge box 42, adjustment link 44, hinge strap 34 and bumper 54 together. Among the fasteners are a lock screw 120, a link position adjustment screw 122 and pivot pins 124 and 126. Mounting bolts 130 and 132 are used to affix hinge box 42 to backshelf 26.

Pivot pin 126 passes through apertures 100 and 104 in adjustment link 44, holes 49 in proximate portion 48 of hinge strap 34, and hole 55 in bumper 54. Accordingly, hinge strap 34 is free to pivot relative to adjustment link 44 about pivot axis 47 with bumper 54 serving as a shock absorber when deck lid 32 is opened.

In turn, adjustment link 44 is pivotally attached to hinge box 42. Pivot pin 124 passes through holes 87 and 88 in hinge box 42 and apertures 102 and 106 in adjustment link 44. Link position adjustment screw 122 passes through access hole 83 in domed wall 64 and is received in threaded hole 112. By screwing arcuate adjustment screw 122 into and out of threaded hole 112, adjustment link 44 and second pivot axis 47 move arcuately relative to hinge box 42. Lock screw 120 acts as a locking mechanism and passes through elongate slot 84 in domed wall 64 and is threadedly received in threaded aperture 110 in forward flange 96 of adjustment link 44. Lock screw 120 is used to clampingly lock adjustment link 44 in a desired position relative to hinge box 42.

Figure 6:
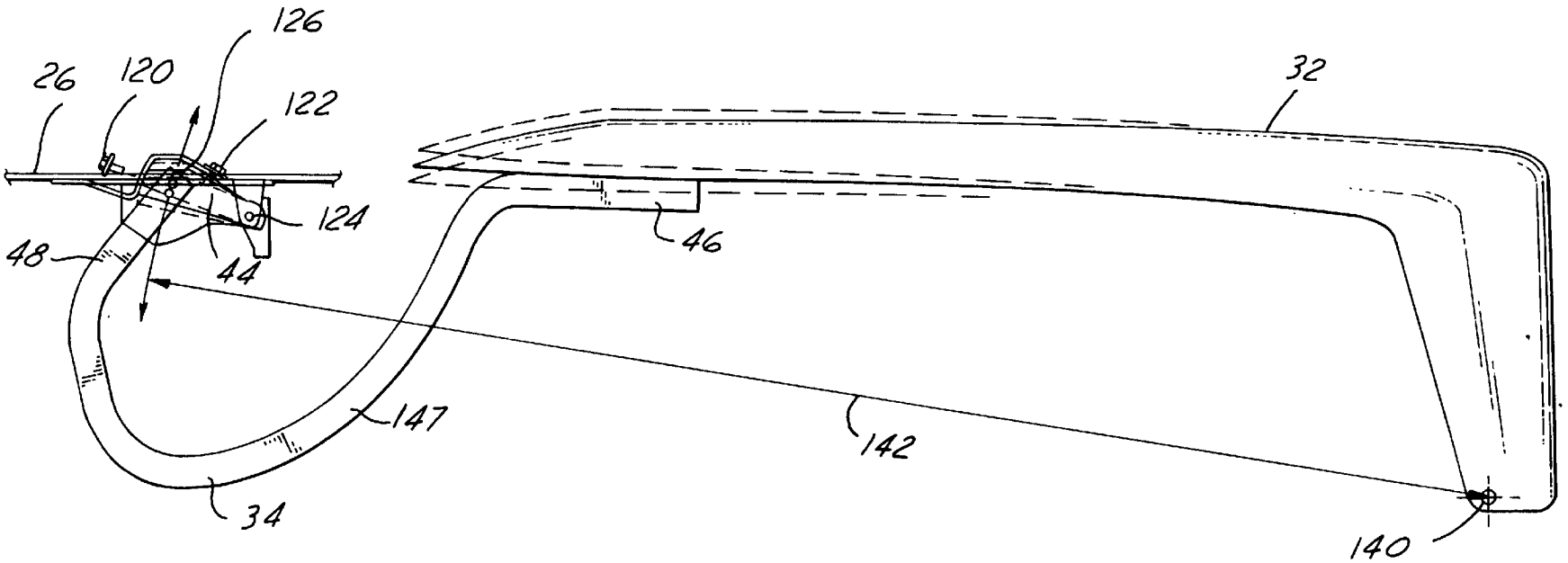
FIG. 6 is a schematic view of one of the adjustable hinge assemblies and the deck lid being pivotally adjusted relative to a back shelf of the vehicle.

Referring to FIG. 6, after both hinge straps 34 and hinge assemblies 22 have been mounted to backshelf 26, the position of deck lid 32 relative to deck lid opening 30 can be adjusted. Ideally, deck lid 32 will flushly mate with the surrounding surfaces on the body of vehicle 20.

Threading arcuate adjustment screws 122 into and out of corresponding threaded holes 112 of adjustment links 44 causes adjustment links 44 to pivot about pivot pins 124. Accordingly, proximate portions 48 of hinge straps 34 raise and lower relative to backshelf 26. In turn, this raises and lowers the forward portion of deck lid 32 so that deck lid 32 may be properly positioned relative to deck lid opening 30. Lock screws 120 are tightened to lock adjustment links 44 in this desired position relative to hinge boxes 42.

As best seen in FIG. 6, adjustment link 44 pivots about pivot pin 124 and first pivot axis 45 defined by holes 87 and 88 in hinge box 42. Pivot pin 126 pivotally connects hinge strap 34 with respect to adjustment link 44 about second pivot axis 47 defined by apertures 100 and 104 in adjustment link 44. Consequently, second pivot axis 47 moves along an arcuate path thus providing both horizontal and vertical components of movement to pivot pin 126 and hinge strap 34.

For example, when deck lid 32 is to be raised, adjustment link 44 is rotated upward or clockwise, as indicated in FIG. 6, using adjustment screw 122. Pivot pin 126, coaxially aligned along second pivot axis 47, moves vertically upwardly and horizontally rearwardly. This rearward movement allows the rear portion of deck lid 32 to remain relative free of horizontal translation. Had pivot pin 126 been raised only in a vertical plane, this would have necessarily required a latch point located at the rear of deck lid 34 and identified by reference numeral 140, to move forwardly. This is because the distance between pivot pin 126 and the latch point 140 is fixed. This distance is shown by diagonal line 142. Similarly, when arcuate link 44 is lowered or rotated counterclockwise, pivot pin 126 moves downwardly and forwardly again allowing the rear portion of deck lid 32 to remain relative free of horizontal translation. The arc through which pivot pin 126 travels when pivoting about pivot pin 124 is similar to the arc pivot pin 126 would pass through if pivoted about latch point 140.

While the foregoing specification of this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of the invention.

What is claimed is:

1. An adjustable hinge assembly for swingably supporting a deck lid on the back shelf of a vehicle, the deck lid provided with a deck lid latch point, wherein the deck lid is held closed by engagement of the deck lid latch point with a deck lid latch at the back end of the trunk space of the vehicle, the hinge assembly comprising:

a hinge box mountable to the back shelf of a vehicle; and an adjustment link pivotally mounted to the hinge box about a first pivot axis;

said adjustment link having a mounting portion for receiving and supporting a hinge strap and an associated deck lid for swingable movement about a second pivot axis;

said adjustment link being pivotable about said first pivot axis to swing the second pivot axis along an arcuate path about the first pivot axis;

whereby a deck lid carried by the hinge assembly may be adjusted to conform the deck lid to adjacent portions of the vehicle body near the back shelf without disturbing the conformation of the deck lid near the deck lid latch.

2. The hinge assembly of claim 1 further comprising:

an adjustor for adjusting the position of the adjusting link relative to the hinge box thereby pivoting the adjustment link about the first pivot axis.

3. The hinge assembly of claim 1 wherein:

the mounting portion includes a pair of coaxially aligned apertures in the adjustment link.

4. The hinge assembly of claim 1 further comprising:

a locking mechanism for locking the adjustment link relative to the hinge box after the adjustment link has been pivoted about the first pivot axis to a desired position.

5. The hinge assembly of claim 4 wherein:

the locking mechanism is a threaded fastener.

6. The hinge assembly of claim 2 wherein:

the adjustor is a threaded fastener extending between the hinge box and the adjustment link.

7. A method of adjusting a deck lid relative to a trunk opening in a vehicle, the deck lid provided with a deck lid latch point, wherein the deck lid is held closed by engagement of the deck lid latch point with a deck lid latch at the back end of the trunk opening of the vehicle, the method comprising:

attaching at least one hinge assembly to the back shelf of a vehicle, the at least one hinge assembly including a hinge box mounted to the back shelf of the vehicle and an adjustment link pivotally mounted to the hinge box about a first pivot axis;

mounting a hinge strap and an associated deck lid on the adjustment link for swingable movement about a second pivot axis; and pivoting the adjustment link about the first pivot axis to swing the second pivot axis along an arc about the first pivot axis;

whereby a deck lid carried by the hinge assembly may be adjusted to conform the deck lid to adjacent portions of the vehicle body near the back shelf without disturbing the conformation of the deck lid near the deck lid latch.

8. The method of claim 7 further comprising:

locking the adjustment link in a fixed arcuate position relative to the hinge box using a locking mechanism.

* * * * *